US007150309B2

(12) United States Patent
Newcomb

(10) Patent No.: US 7,150,309 B2
(45) Date of Patent: Dec. 19, 2006

(54) CYLINDER BORE LINERS FOR CAST ENGINE CYLINDER BLOCKS

(75) Inventor: Thomas P. Newcomb, Defiance, OH (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/936,976

(22) Filed: Sep. 9, 2004

(65) Prior Publication Data

US 2006/0048911 A1 Mar. 9, 2006

(51) Int. Cl.
*B22D 17/24* (2006.01)

(52) U.S. Cl. ..... 164/332; 164/333; 164/334; 164/370

(58) Field of Classification Search ..... 164/332, 164/333, 334, 137, 9, 11, 30, 370
See application file for complete search history.

(56) References Cited

U.S. PATENT DOCUMENTS 3,382,857 A * 5/1968 Foster et al. ..... 123/193.1
5,771,955 A * 6/1998 Helgesen et al. ..... 164/9
5,862,852 A * 1/1999 Shibata et al. ..... 164/80
6,615,901 B1 * 9/2003 Kaminski et al. ..... 164/137
6,942,007 B1 * 9/2005 Meyer ..... 164/137

* cited by examiner

*Primary Examiner*—Kevin Kerns
*Assistant Examiner*—I.-H. Lin
(74) *Attorney, Agent, or Firm*—Charles H. Ellerbrock

(57) ABSTRACT

A cast-in-place cylinder bore liner (15) is disclosed for use in sand casting of engine cylinder blocks, the cylinder bore liner (15) having a protuberant portion (60) adjacent a first end (61) thereof, whereby accuracy in the positioning of cast-in-place bore liners (15) is maximized.

18 Claims, 4 Drawing Sheets

CYLINDER BORE LINERS FOR CAST ENGINE CYLINDER BLOCKS

FIELD OF THE INVENTION

The invention relates to a cylinder bore liner and more particularly to a cast-in-place cylinder bore liner for use in sand casting of engine cylinder blocks wherein the liner includes a protuberant portion formed at one end thereof.

BACKGROUND OF THE INVENTION

In the manufacture of cast iron engine V-blocks, a so-called integral barrel crankcase core has been used and consists of a plurality of tapered barrels formed integrally on a crankcase region of the core. The barrels form the cylinder bores in the cast iron engine block without the need for bore liners.

For a sand casting process of an aluminum internal combustion engine cylinder V-block, an expendable mold package is assembled from a plurality of resin-bonded sand cores (also known as mold segments) that define the internal and external surfaces of the engine V-block. Typically, each of the sand cores is formed by blowing resin-coated foundry sand into a core box and curing it therein. Cast-in-place bore liners are often used in such castings.

Typically, in the manufacture of an aluminum engine V-block with cast-in-place bore liners, the mold assembly method involves positioning a base core on a suitable surface and building up or stacking separate mold elements to shape such casting features as the sides, ends, valley, water jacket, cam openings, and crankcase. The bore liners are positioned on barrel cores such that the liners become embedded in the casting after the metal is poured into the mold. Additional cores may be present as well depending on the engine design. Various designs for the barrel cores are used in the industry. These include individual barrel cores, "V" pairs of barrel cores, barrel-slab cores, and integral barrel crankcase cores. The barrel-slab and integral barrel crankcase designs are often preferred because they provide more accurate positioning of the liners within the mold assembly. These barrel core designs often require that the barrel features are tapered to allow removal thereof from the tooling used to form them.

The engine block casting must be machined in a manner to ensure, among other things, that the cylinder bores (formed from the bore liners positioned on the barrel features of the barrel cores) have uniform bore liner wall thickness, and other critical block features are accurately machined. This requires the liners to be accurately positioned relative to one another within the casting, and that the block is optimally positioned relative to the machining equipment.

The ease and consistency with which the liners are brought into the desired final position during the mold assembly process is an important consideration. Additionally, the amount of machining required to prepare the cast engine block for assembly in a vehicle should be considered.

It would be desirable to produce a cylinder bore liner for cast engine cylinder blocks wherein accuracy in the positioning of the bore liners is maximized and an amount of material required to be removed from the bore liners during a machining thereof is minimized.

SUMMARY OF THE INVENTION

Consistent and consonant with the present invention, a cylinder bore liner for cast engine cylinder blocks wherein accuracy in the positioning of the bore liners is maximized and an amount of material required to be removed from the bore liners during a machining thereof is minimized, has surprisingly been discovered.

In one embodiment, a cylinder bore liner for cast engine cylinder blocks comprises a hollow cylindrical main body having a substantially circular cross section, a first end, and a second end, the first end of the main body having a radially inwardly extending protuberant portion formed thereon to facilitate an alignment of the main body on an associated cylinder barrel, an inner wall of the main body having a substantially uniform diameter.

In another embodiment, a mold for sand casting of engine cylinder blocks comprises at least one cylinder barrel extending outwardly from a base end to terminate at a free end, an outer wall of the at least one cylinder barrel being tapered from the base end to the free end; and a bore liner having a substantially circular cross section, a first end, and a second end, the bore liner disposed on the at least one cylinder barrel, the first end of the bore liner having a radially inwardly extending protuberant portion formed thereon to facilitate an alignment of the bore liner on the cylinder barrel, an inner wall of the bore liner being non-tapered in an axial direction of the bore liner.

In another embodiment, a mold for sand casting of engine cylinder blocks comprises an integral barrel crankcase core adapted to be assembled in a mold package, the integral barrel crankcase core including a crankcase core region; a plurality of spaced apart cylinder barrels arranged to form at least one row and extending outwardly from a base end disposed on the crankcase core region to terminate at a free end; and a plurality of hollow cast-in-place bore liners having a substantially circular cross section, a first end, and a second end, one of the bore liners disposed on each of the cylinder barrels, the first end of the bore liners having a radially inwardly extending protuberant portion formed thereon to facilitate an alignment of the bore liners on the cylinder barrels, an inner wall of the bore liners being non-tapered in an axial direction of the bore liners.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Commonly owned U.S. Pat. No. 6,615,901 B2 and U.S. patent application Ser. No. 10/862,072 filed Jun. 4, 2004 are hereby incorporated herein by reference.

Figure 1:
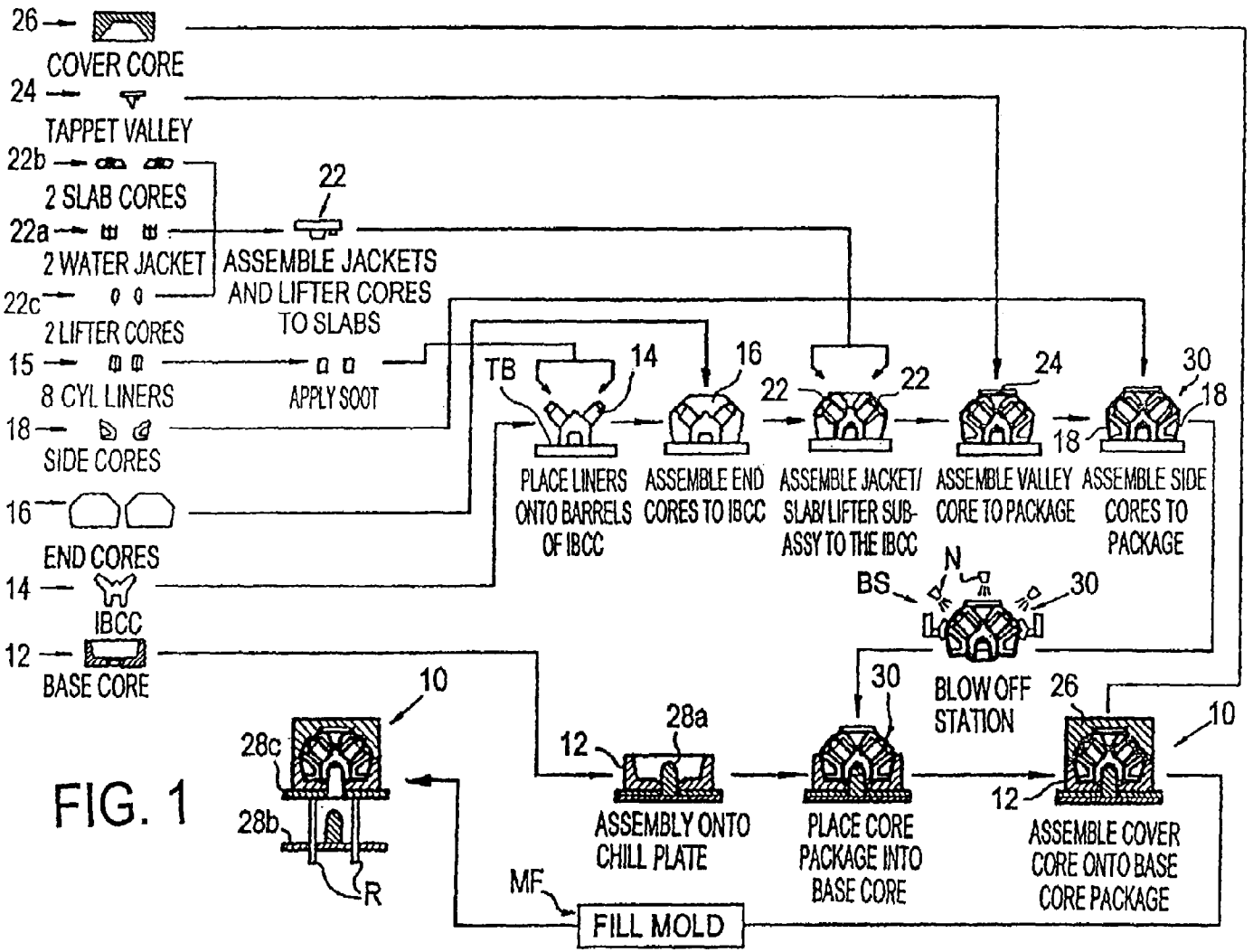
FIG. 1 is a flow diagram showing an assembly process for an engine V-block mold package with the front end core omitted for clarity.

FIG. 1 depicts a flow diagram showing a sequence for assembling an engine cylinder block mold package 10. The invention is not limited to the sequence of assembly steps shown as other sequences can be employed to assemble the mold package. For purposes of illustration, and not limitation, a core for an eight-cylinder V-type engine is shown. It is understood that more or fewer cylinders can be used and that other engine cylinder configurations can be used according to the invention without departing from the scope and spirit thereof. It is also understood that the features of the invention could be used with other core types. In the embodiment shown, a resin bonded sand core is used.

The mold package 10 is assembled from resin-bonded sand cores including a base core 12 mated with a crankcase chill 28*a*, a chill plate 28*b*, and a mold carrier plate 28*c*, an integral barrel crankcase core (IBCC) 14 having a metal cylinder bore liner or hollow cylindrical main body 15 disposed on an associated cylinder barrel 50, two end cores 16, two side cores 18, two water jacket slab core assemblies 22, a tappet valley core 24, and a cover core 26. The water jacket slab core assembly 22 includes a water jacket core 22*a*, a jacket slab core 22*b*, and a lifter core 22*c*. The cores 12, 14, 16, 18, 22, 24, 26 described above are offered for purposes of illustration and not limitation as other types of cores and core configurations may be used in assembly of the engine cylinder block mold package 10 depending upon the particular engine block design to be cast. For illustrative purposes, only a crankcase chill 28*a* has been shown in FIG. 1, however, it is understood that other chill types can, and typically are, used as desired. The use of chills in a casting process such as that described herein facilitates forming of a desired grain structure in cast metal parts.

The resin-bonded sand cores can be made using conventional core-making processes such as a phenolic urethane cold box or Furan hot box where a mixture of foundry sand and resin binder is blown into a core box and the binder cured with either a catalyst gas and/or heat. The foundry sand can comprise silica, zircon, fused silica, and others.

The cores 14, 16, 18, 22, 24 initially are assembled apart from the base core 12 and cover core 26 to form a subassembly or core package 30 of multiple cores. The cores 14, 16, 18, 22, 24 are assembled on a temporary base or member TB that does not form a part of the final engine block mold package 10.

The subassembly 30 and the temporary base TB are separated by lifting the subassembly 30 off of the temporary base TB at a separate station. The temporary base TB is returned to the starting location of the subassembly sequence where a new integral barrel crankcase core 14 is placed thereon for use in assembly of another subassembly 30.

The subassembly 30 is taken to a cleaning station or blow-off station BS, where the subassembly 30 is cleaned to remove loose sand from the exterior surfaces of the subassembly 30 and from interior spaces between the cores 12, 16, 18, 22, 24, 26 thereof. The loose sand typically is present as a result of the cores rubbing against one another at the joints therebetween during the subassembly sequence.

The blow-off station BS typically includes a plurality of high velocity air nozzles N which direct high velocity air on exterior surfaces of the subassembly 30 and into the narrow spaces between adjacent cores 12, 16, 18, 22, 24, 26 to dislodge any loose sand particles and cause the sand to be blown out of the subassembly 30. In lieu of, or in addition to, moving the subassembly 30, the nozzles N may be movable relative to the subassembly 30 to direct high velocity air at the exterior surfaces of the subassembly 30 and into the narrow spaces between adjacent cores 12, 16, 18, 22, 24, 26. It is understood that other cleaning methods can be used as desired such as the use of a vacuum cleaning station, for example.

The cleaned subassembly 30 is positioned on base core 12 residing on the chill plate 28*b*. Chill plate 28*b* includes the mold stripper plate 28*c* disposed on the chill plate 28*b* to support the base core 12. The base core 12 is placed on the mold stripper plate 28*c* with the crankcase chill 28*a* disposed on the chill plate 28*b*. The crankcase chill 28*a* can be produced from an assembly or formed as a unitary structure. The crankcase chill 28*a* extends through an opening formed in mold carrier plate 28*c* and an opening formed in the base core 12 into a cavity formed in the core 14. The crankcase chill 28*a* can be made of cast iron or other suitable thermally conductive material to rapidly remove heat from the bulkhead features of the casting, the bulkhead features being those casting features that support the engine crankshaft via the main bearings and main bearing caps.

The chill plate 28*b* includes apertures through which lifting rods R extend which facilitate separating the crankcase chill 28*a* from the mold carrier plate 28*c* and mold package 10. The chill plate 28*b* and the mold carrier plate 28*c* can be constructed of steel, thermal insulating ceramic plate material, combinations thereof, or other durable material. The function of the chill plate 28*b* is to facilitate the handling of the crankcase chill 28*a* and other chills, and the function of the mold carrier plate 28*c* is to facilitate the handling of the mold package 10. The chill plate 28*b* and the mold carrier plate 28*c* typically are not intended to play a significant role in extraction of heat from the casting, however.

The cover core 26 is placed on the base core 12 and subassembly 30 to complete assembly of the engine block mold package 10. Additional cores (not shown) which are not part of the subassembly 30 can be placed on or fastened to the base core 12 and the cover core 26 as desired before being moved to the assembly location where the base core 12 and the cover core 26 are united with the subassembly 30. For example, the subassembly 30 can be assembled without side cores 16, which instead are assembled on the base core 12. The subassembly 30 without side cores 16 is subsequently placed in the base core 12 having side cores 16 thereon.

The completed engine block mold package 10 is moved to a mold filling station MF, where the mold package 10 is filled with molten metal such as molten aluminum, for example. Any suitable mold filling technique may be used to fill the mold package 10 such as gravity pouring or electromagnetic pumping, for example.

After a predetermined time following casting of the molten metal into the mold package 10, the mold package 10 is moved to a station where the lift rods R are inserted through the holes of chill plate 28*b* to raise and separate the mold carrier plate 28*c* with the cast mold package 10 thereon from the chill plate 28*b*. The chill plate 28*b* can be returned to the beginning of the assembly process for reuse in assembling another mold package 10. The cast mold package 10 can be further cooled on the mold carrier plate 28*c*.

Figure 2:
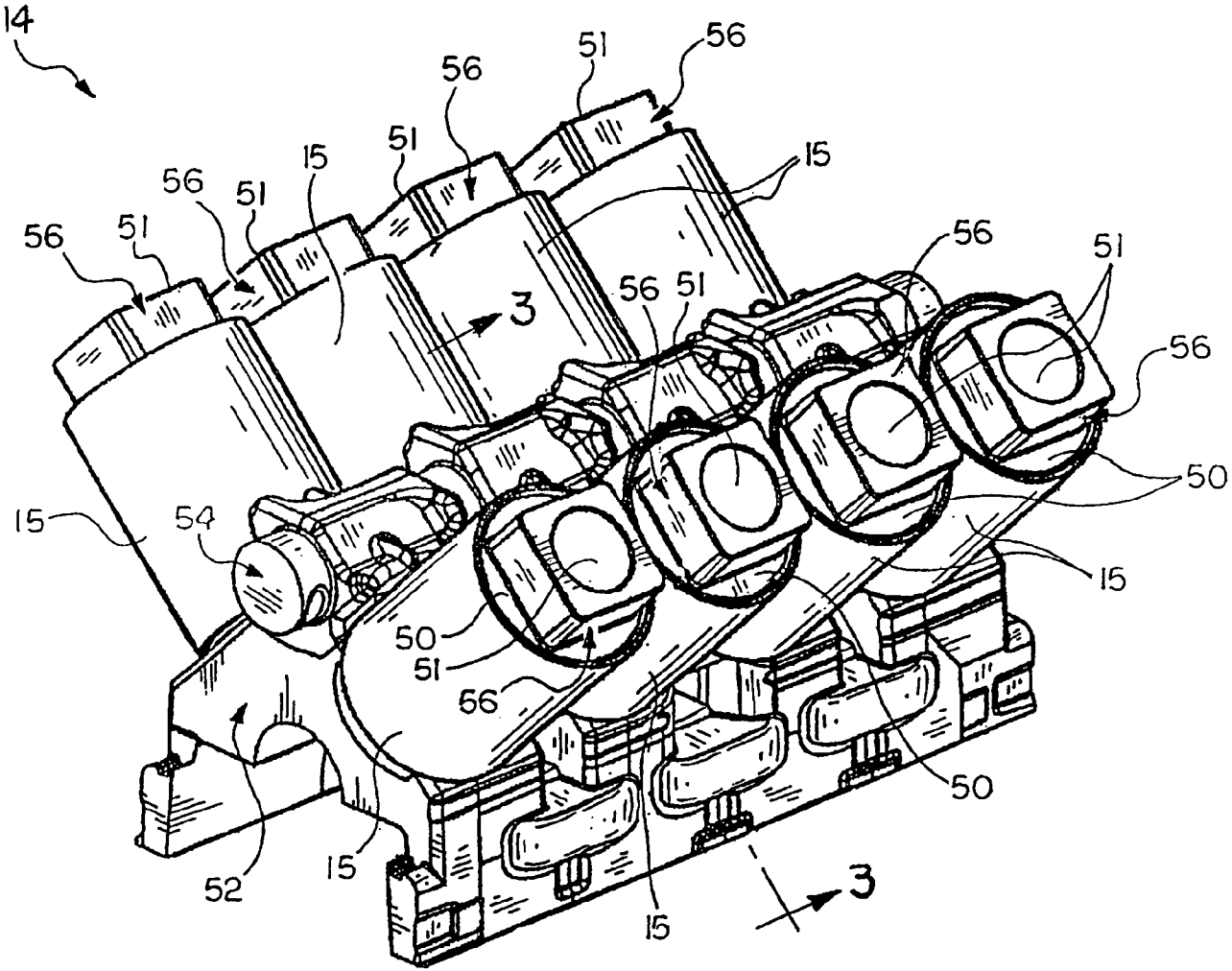
FIG. 2 is a perspective view of an integral barrel crankcase core showing a bore liner disposed on each of the barrels thereof.

Referring now to FIG. 2, the integral barrel crankcase core 14 according to an embodiment of the invention is shown. It is understood that the features of the invention described herein could be used with a barrel-slab core or other barrel core type. The cylinder barrels 50 extend outwardly from the integral barrel crankcase core 14 and terminate at a free end 51. From a base end 47 to the free end 51, an outer wall 49 of the cylinder barrels 50 has a taper or a draft angle such that a diameter of the cylinder barrel 50 decreases from the base end 47 to the free end 51. The taper of the cylinder barrels 50 is represented by angle A in FIG. 4 and is typically up to 1 degree. The taper is exaggerated in the drawings for clarity. In the V-type engine, the cylinder barrels 50 are disposed in two rows of cylinder barrels 50 with planes through an axis or centerline of the cylinder barrels 50 of each row. The planes of each row of the cylinder barrels 50 intersect at an angle to one another in a crankcase portion of the engine block casting (not shown). Common configurations include V6 engine blocks with 54°, 60°, 90°, and 120° of included angle between the two rows of the cylinder barrels 50 and V8 engine blocks with a 90° angle between the two rows of the cylinder barrels 50, although other configurations can be used. The cylinder barrels 50 are disposed on a crankcase core region or section 52. In the embodiment shown, a cam shaft passage forming region 54 is integrally formed with the crankcase core region 52 on the integral barrel crankcase core 14.

Each of the cylinder barrels 50 includes a core print 56 formed thereon. The core prints 56 are shown as flat-sided polygons in shape for purposes of illustration only, as other shapes and configurations of core prints 56 can be used. Additionally, although male core prints 56 are shown, it is understood that female core prints can be used. The core prints 56 are adapted to mate with corresponding core prints formed on the water jacket slab core assembly 22 as shown in FIG. 3.

The bore liners 15 form a cylinder wall for each cylinder of the engine block after the casting thereof. The cylinder bore liners 15 can be machined or cast. In the embodiment shown and described, the engine block is cast from aluminum. It is understood that other materials can be used for the bore lines 15 and the engine block as desired such as cast iron or an aluminum alloy, for example. The bore liners 15 are typically formed of cast iron and have a substantially circular cross section and have a hollow interior of substantially uniform diameter.

Figure 4:
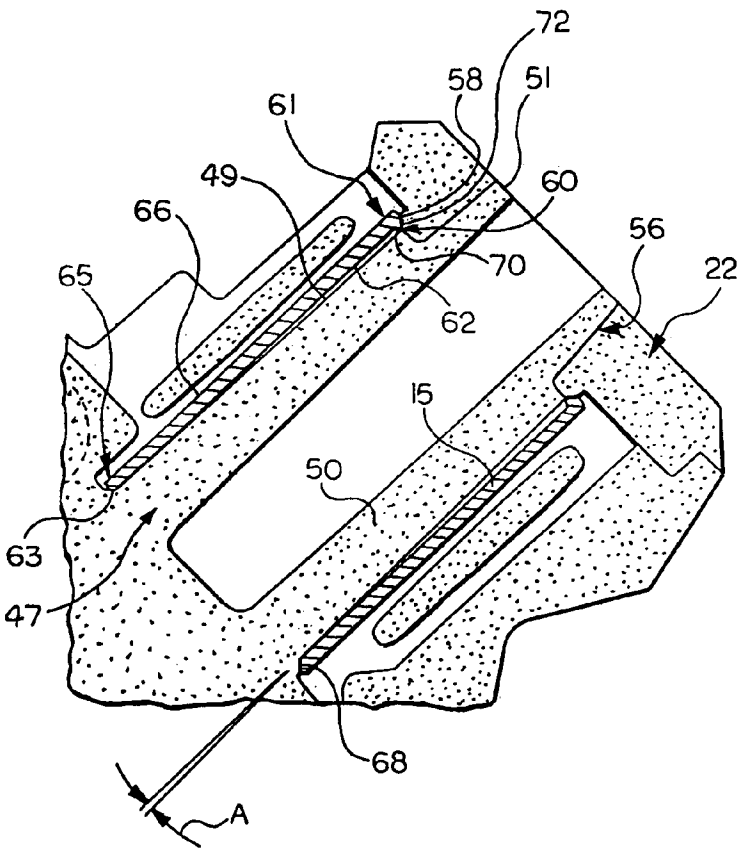
FIG. 4 is an enlarged sectional view of a barrel of the barrel crankcase core and a water jacket slab core illustrated in FIG. 3 and showing a cylinder bore liner with a protuberant section adjacent an end thereof.
Figure 3:
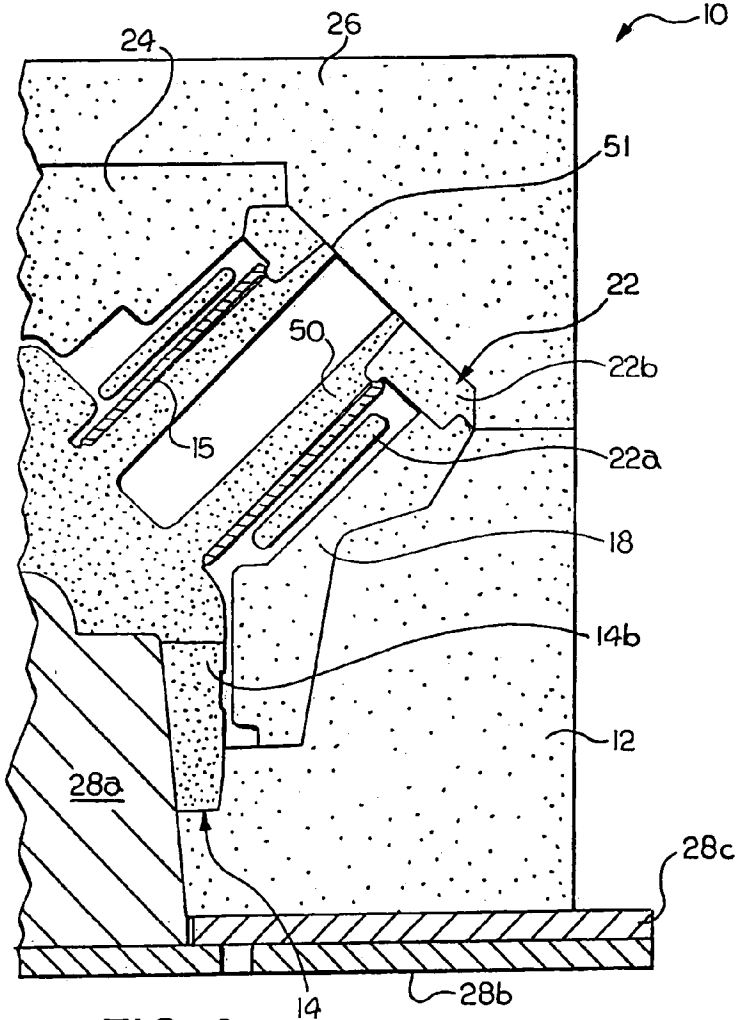
FIG. 3 is a partial sectional view of an engine block mold package according to an embodiment of the invention taken along line 3—3 of FIG. 2 through a central plane of a barrel.

FIGS. 3 and 4 show a sectional view of one of the bore liners 15 in the engine cylinder block mold package 10. The bore liner 15 illustrated in FIG. 4 shows one embodiment of the invention and includes a protuberant portion 60 adjacent a first end 61 thereof. The protuberant portion 60 has a first sloped wall 70 and a second sloped wall 72. The first wall 70 extends radially inwardly from an inner wall 62 of the bore liner 15. An annular chamfer or sloped portion 58 is formed at the first end 61 of the bore liner 15. The chamfer 58 extends to meet the second wall 72, the second wall 72 then extending to meet the first wall 70 at an apex. In the embodiment shown, the chamfer 58 and the second wall 72 have the same slope. It is understood that the chamfer 58 and the second wall 72 can have different slopes. Additionally, the second wall 72 can be perpendicular to the inner wall 62 of the bore liner 15. Also in the embodiment shown, the contact area between the protuberant portion 60 and the cylinder barrel 50 is an annular line or ring adjacent or very near the free end 51 of the cylinder barrel 50. It is understood that other contact surface configurations could be used such as an annular array of protuberances, for example, without departing from the scope and spirit of the invention. An annular chamfer 63 is formed on a second end 65 of the bore liner 15.

Figure 5:
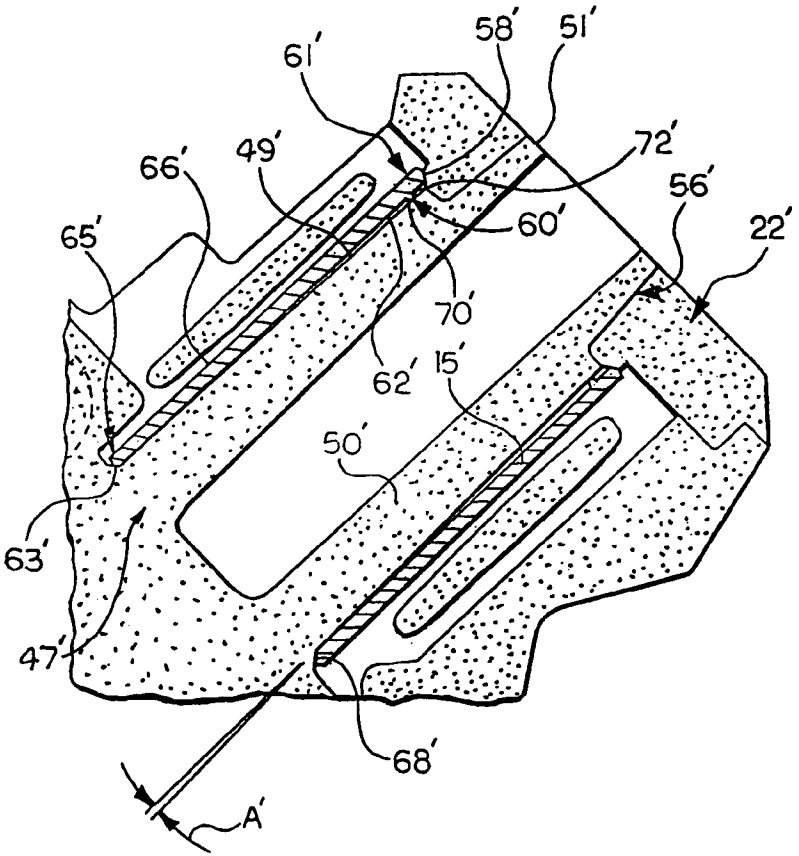
FIG. 5 is an enlarged sectional view of a barrel of the barrel crankcase core and a water jacket slab core according to another embodiment of the invention showing a cylinder bore liner with a protuberant section spaced from an end thereof.

FIG. 5 shows another embodiment of the invention. Like structure from FIGS. 3 and 4 have the same reference numeral and a prime (') for clarity. The disclosure in respect of the relation of the structures and the use thereof also applies to the embodiment disclosed in FIG. 5. The bore liner 15' illustrated in FIG. 5 includes a protuberant portion 60' spaced from adjacent a first end 61' thereof. The protuberant portion 60' extends radially inwardly from an inner wall 62' of the bore liner 15'. In the embodiment shown, the contact area between the protuberant portion 60' and the cylinder barrel 50' is an annular line or ring. It is understood that other contact surface configurations could be used such as an annular array of protuberances, for example, without departing from the scope and spirit of the invention.

Figure 6:
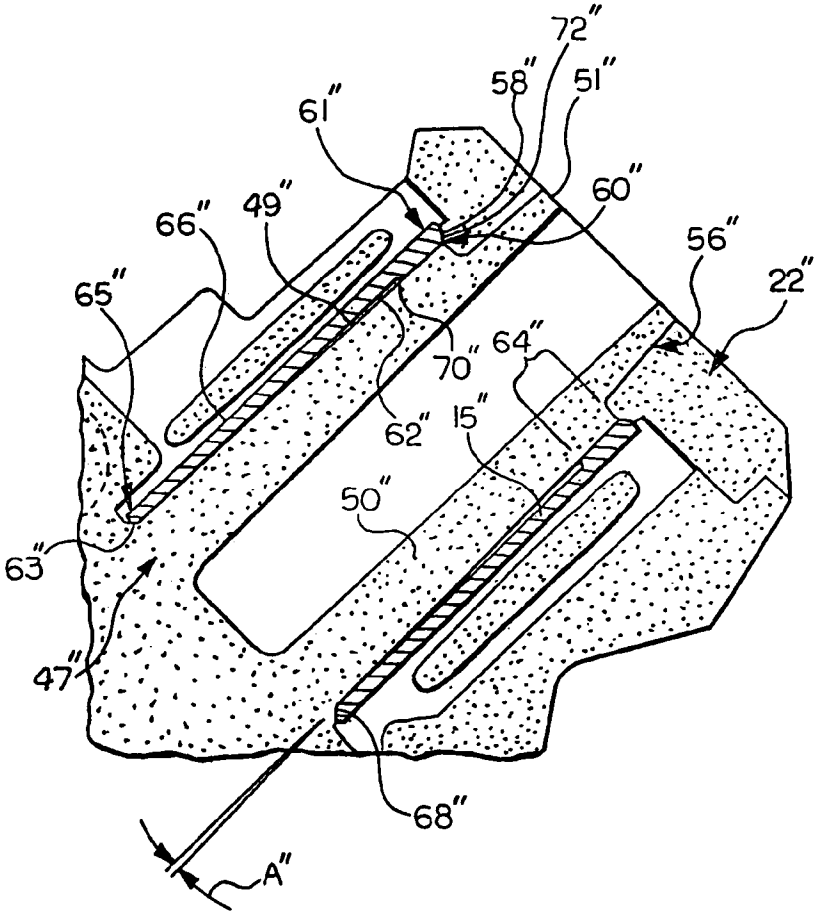
FIG. 6 is an enlarged sectional view of a barrel of the barrel crankcase core and a water jacket slab core according to another embodiment of the invention showing a cylinder bore liner with a non-tapered plateau section adjacent an end thereof.

FIG. 6 shows another embodiment of the invention. Like structure from FIGS. 3 and 4 have the same reference numeral and a double prime (") for clarity. The disclosure in respect of the relation of the structures and the use thereof also applies to the embodiment disclosed in FIG. 6. The bore liner 15" illustrated in FIG. 6 includes a protuberant portion 60" adjacent a first end 61" thereof. The protuberant portion 60" extends radially inwardly from an inner wall 62" of the bore liner 15". An annular band region or plateau region 64" is formed on the protuberant portion 60". The annular band region 64" is not tapered with respect to the inner wall 62" of the bore liner 15" or has a substantially uniform diameter in an axial direction of the bore liner 15". Thus, the inner wall 62" and the annular band region 64" are substantially concentric, and an axial line taken along the inner wall 62" and an axial line taken along the annular band region 64" are substantially parallel. It is understood that other contact surface configurations could be used such as an annular array of protuberances having band regions or plateaus formed thereon, for example, without departing from the scope and spirit of the invention.

In use, one of the bore liners 15 is positioned on each of the cylinder barrels 50. As previously described, the integral barrel crankcase core 14 is first placed on the temporary base TB. A metal cylinder bore liner 15 is placed manually or robotically on each barrel 50 of the integral barrel crankcase core 14. Prior to placement on a barrel 50, each liner outer wall 66 may be coated with soot including carbon black, for example, for the purpose of encouraging intimate mechanical contact between the liner and the cast metal. The integral barrel crankcase core 14 is made in core box tooling (not shown) to include a chamfered (conical) lower annular liner positioning surface 68 at the lower end of each barrel 50 as shown in FIG. 4. The chamfered surface 68 engages the chamfer 63 of each bore liner 15 to aid in positioning of the bore liner 15 relative to the barrel 50 before and during casting of the engine block.

As previously disclosed, the bore liners 15 have a substantially circular cross section and have a hollow interior of substantially uniform diameter. The inner wall 62 is not tapered with respect to a longitudinal axis of the bore liner 15. When assembled, the inner wall 62 of each of the bore liners 15 is disposed adjacent the tapered wall of the barrel 50 and a space is left therebetween over at least a portion of the length of the bore liner 15. The taper of the barrel 50 facilitates removal of the integral barrel crankcase core 14 from the core box tooling in which it is formed.

The protuberant portion 60 facilitates an initial alignment of each bore liner 15 on the associated barrel 50 with respect to the water jacket slab core 22 that will be fitted on the barrels 50. As each bore liner is placed on the associated barrel 50, the bore liner 15 may be misaligned with the barrel 50. This is especially true for V-type engines where the barrel 50 and the bore liner 15 are disposed at a non-vertical angle. The sloped wall of the protuberant portion 60 causes the bore liner 15 to be moved into an improved alignment when the sloped wall abuts the free end 51 of the barrel 50.

Final alignment of the bore liner 15 is achieved when the water jacket slab core assembly 22 is assembled in the mold package 10 as the water jacket slab core assembly 22 abuts the chamfer 58. The protuberant portion 60 is removed during machining of the engine block after casting. Due to the small area being machined to remove the protuberant portion 60, the machining time and the costs associated therewith are minimized compared with a liner with a substantial portion of the liner ID tapered.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A cast-in-place cylinder bore liner for forming a cylinder wall in an engine block comprising:

a hollow cylindrical main body (15) having a substantially circular cross section, a first end (61), and a second end (65), the first end (61) of said main body (15) having a radially inwardly extending protuberant portion (60) formed on an inner wall (62) thereof to facilitate an alignment of said main body (15) on an associated cylinder barrel (50), a remainder of the inner wall (62) of said main body (15) having a substantially uniform diameter.

2. The liner according to claim 1, wherein the protuberant portion (60) is spaced from the first end (61) of said main body (15).

3. The liner according to claim 1, wherein the protuberant portion (60) includes a plateau region (64") formed thereon adapted to abut the associated cylinder barrel (50), the plateau region (64") having a substantially uniform diameter in an axial direction of said main body (15).

4. The liner according to claim 1, wherein said main body (15) includes an annular array of radially inwardly extending protuberant portions (60) formed thereon.

5. The liner according to claim 1, wherein a contact area between the protuberant portion (60) and the associated cylinder barrel (50) is an annular Line.

6. The liner according to claim 5, wherein the protuberant portion (60) includes a pair of sloped walls (70,72) extending radially inwardly from the inner wall (62) of the main body (15) to meet at an apex.

7. A mold for sand casting of engine cylinder blocks comprising:

at least one cylinder barrel (50) extending outwardly from a base end (47) to terminate at a free end (51), an outer wall (49) of said at least one cylinder barrel (50) being tapered from the base end (47) to the free end (51); and a bore liner (15) having a substantially circular cross section, a first end (61), and a second end (65), said bore liner (15) disposed on said at least one cylinder barrel (50), the first end (61) of said bore liner (15) having a radially inwardly extending protuberant portion (60) formed on an inner (62) wall thereof to facilitate an alignment of said bore liner (15) on said cylinder barrel (50), a remainder of the inner wall (62) of said bore liner (15) being non-tapered in an axial direction of said bore liner (15).

8. The mold according to claim 7, wherein the protuberant portion (60) is spaced from the first end (61) of said bore liner (15).

9. The mold according to claim 7, wherein the protuberant portion (60) of said bore liner (15) includes a plateau region (64") formed thereon adapted to abut said at least one cylinder barrel (50), the plateau region (64") having a substantially uniform diameter in an axial direction of said bore liner (15).

10. The mold according to claim 7, wherein said bore liner (15) includes an annular array of radially inwardly extending protuberant portions (60) formed thereon.

11. The mold according to claim 7, wherein a contact area between the protuberant portion (60) of said bore liner (15) and said cylinder barrel (50) is an annular line.

12. The mold according to claim 11, wherein the protuberant portion (60) includes a pair of sloped walls (70,72) extending radially inwardly from the inner wall (62) of said bore liner (15) to meet at an apex.

13. A mold for sand casting of engine cylinder blocks comprising:

an integral barrel crankcase core (14) adapted to be assembled in a mold package (10), said integral barrel crankcase core (14) including a crankcase core region (52);

a plurality of spaced apart cylinder barrels (50) arranged to form at least one row and extending outwardly from a base end (47) disposed on the crankcase core region (52) to terminate at a free end (51); and a plurality of hollow cast-in-place bore liners (15) having a substantially circular cross section, a first end (61), and a second end (65), one of said bore liners (15) disposed on each of said cylinder barrels (50), the first end (61) of said bore liners (15) having a radially inwardly extending protuberant portion (60) formed on an inner (62) wall thereof to facilitate an alignment of said bore liners (15) on said cylinder barrels (50), a remainder of the inner wall (62) of said bore liners (15) being non-tapered in an axial direction of said bore liners (15).

14. The mold according to claim 13, wherein the protuberant portion (60) is spaced from the first end (61) of each of said bore liners (15).

15. The mold according to claim 13, wherein the protuberant portion (60) of each of said bore liners (15) includes a plateau region (64") formed thereon adapted to abut said cylinder barrel (50) associated therewith, the plateau region (64") having a substantially uniform diameter in an axial direction of said bore liners (15).

16. The mold according to claim 13, wherein each of said bore liners (15) includes an annular array of radially inwardly extending protuberant portions (60) formed thereon.

17. The mold according to claim 13, wherein a contact area between the protuberant portion (60) of each of said bore liners (15) and said cylinder barrel (50) associated therewith is an annular line.

18. The mold according to claim 17, wherein the protuberant portion (60) includes a pair of sloped walls (70,72) extending radially inwardly from the inner wall (62) of said bore liners (15) to meet at an apex.

* * * * *